United States Patent [19]

Buser

[11] 4,121,315

[45] Oct. 24, 1978

[54] BOWLING LANE DUSTER

[76] Inventor: Arthur L. Buser, 2419 S. 128 E. Ave., Tulsa, Okla. 74129

[21] Appl. No.: 797,625

[22] Filed: May 17, 1977

[51] Int. Cl.[2] ..... A47L 13/20

[52] U.S. Cl. ..... 15/228

[58] Field of Search ..... 15/98, 228, 231; 51/361; 242/55.2

[56] References Cited

U.S. PATENT DOCUMENTS

| | | | |
|---|---|---|---|
| 899,725 | 9/1908 | Goodier | 15/228 |
| 1,815,785 | 7/1931 | Leimberger | 242/55.2 |
| 2,394,585 | 2/1946 | Bailey | 15/231 X |
| 2,452,744 | 11/1948 | Gardner | 15/228 UX |
| 2,690,582 | 10/1954 | Sundell | 15/228 |
| 2,810,149 | 10/1957 | Guelker | 15/231 |
| 3,116,504 | 1/1964 | Unterbrink et al. | 15/231 |
| 3,150,407 | 9/1964 | Mitchell | 15/98 X |
| 3,916,470 | 11/1975 | May | 15/230.11 |

FOREIGN PATENT DOCUMENTS

| | | | |
|---|---|---|---|
| 1,940,186 | 2/1970 | Fed. Rep. of Germany | 15/98 |

*Primary Examiner*—Daniel Blum

*Attorney, Agent, or Firm*—Head, Johnson & Chafin

[57] ABSTRACT

A bowling alley lane cleaner having a frame with paralleled end pieces spaced wider than the width of a bowling alley lane, a supply reel having a roll of cleaning paper thereon rotatably mounted between the frame end pieces, an elongated pad of resilient material between the frame end pieces spaced parallel to and below the paper reel, a takeup reel rotatably mounted between the frame end pieces, cleaning paper from the supply reel being looped over the pad and around the takeup reel so that as the device is pulled over a bowling alley lane the paper adjacent the pad engages the lane and cleans dust particles from it, a handle extending from the frame providing means for pulling the device over the lane and ratchet means between the handle and the takeup reel so that each time the user lifts the device to move it from one lane to another the ratchet means automatically advances the takeup reel to insure that clean paper is advanced over the pad to contact the lane being cleaned.

5 Claims, 6 Drawing Figures

BOWLING LANE DUSTER

BACKGROUND AND OBJECTS OF THE INVENTION

In order to insure consistent and accurate bowling it is highly important that bowling alley lanes be kept immaculately clean and free from dirt and dust. Well managed bowling alley operators normally clean their lanes frequently. A commonly used means of cleaning bowling alley lanes is an apparatus which is pulled manually over the lane. The apparatus includes a roll of cleaning paper having a special composition which serves to attract dust as it is pulled over the surface of the lane. The cleaning paper is supplied from a roll and is wrapped around a takeup reel. Periodically the user is required to advance the takeup reel to move clean paper in position so that it engages the lane being cleaned.

While the device in current usage works satisfactorily, one problem is that it depends upon the memory of the user to advance the takeup reel otherwise dirty paper is exposed to the lane being cleaned and unless the user of the device is conscientious and remembers to advance the paper each time a new alley is to be cleaned, the possibility always exists that an alley will not be cleaned as thoroughly as is desired.

The present invention is directed towards a device for cleaning a bowling alley lane and includes means whereby the cleaning paper is automatically advanced so as to expose new cleaning paper each time the apparatus is used without requiring the operator to remember that the paper must be advanced.

It is therefore an object of this invention to provide an improved device for cleaning bowling alley lanes.

More particularly, an object of this invention is to provide a device for cleaning bowling alley lanes including a roll of cleaning paper, a pad over which the cleaning paper is moved for engagement with the lane to be cleaned, a takeup reel to receive used paper thereon, a handle for use in pulling the device over the lane to be cleaned, and a ratchet means interrelating the handle and the takeup reel arranged such that each time the user moves the device to another lane to be cleaned the takeup reel is automatically rotated thereby insuring the advancement of clean paper over the pad.

These general objects, as well as other and more specific objects of the invention will be fulfilled in the following description and claims, taken in conjunction with the attached drawings.

DESCRIPTION OF VIEWS

SUMMARY OF THE INVENTION

Figure 1:
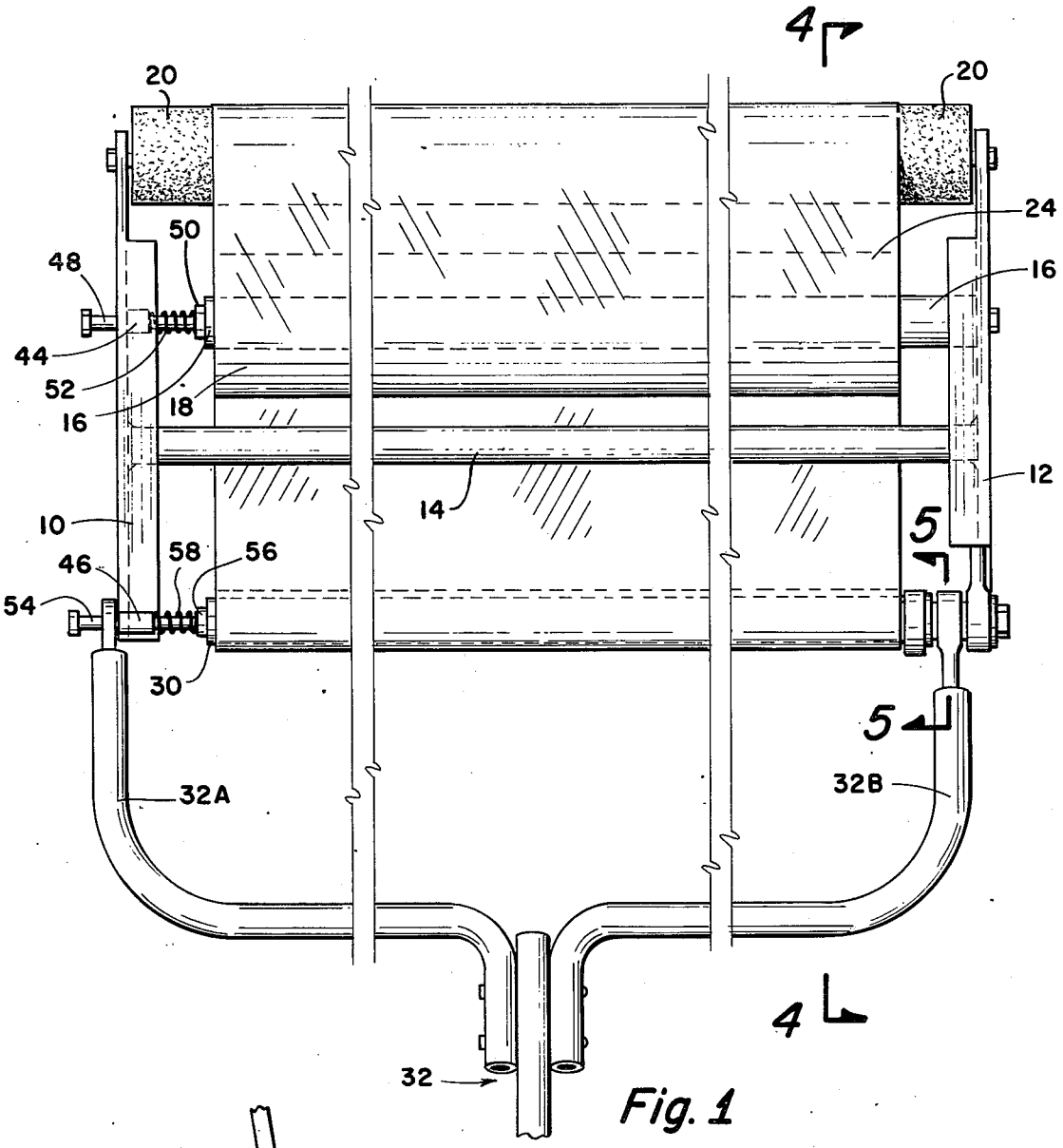
FIG. 1 is a top view of an embodiment of the device for cleaning bowling alley lanes according to this invention.

A bowling alley lane cleaning device is described having means for insuring maximum cleaning effectiveness by eliminating the necessity that the operator must advance cleaning paper each time the device is used to clean a new lane. The device includes parallel end pieces with a roll of cleaning paper rotatably positioned between the end pieces, a pad over which the cleaning paper is carried from the supply roll, the pad serving to press the cleaning paper against the bowling alley surface to be cleaned, and a takeup reel around which the used paper is wound, and a handle pivotally extending from the frame providing means for the operator to pull the device over the lane to be cleaned. A ratchet arrangement is interposed between the pivoted handle and the takeup reel so that each time the operator picks up the device to move it to a new lane the ratchet automatically advances the cleaning paper a preselected amount so that fresh cleaning paper is always pressed by the pad against the lane surface.

DETAILED DESCRIPTION

Referring to the drawings and first to FIGS. 1, 2, 3 and 4, the device includes a frame generally indicated by the numeral 8, having a left end piece 10 and a right paralleled end piece 12. An elongated structural member 14 extends between the end pieces and is secured to each end piece and holds the end pieces spaced apart and parallel to each other. Rotatably positioned between the frame end pieces 10 and 12 is a supply reel 16 having a roll of cleaning paper 18 wound thereon.

Figure 2:
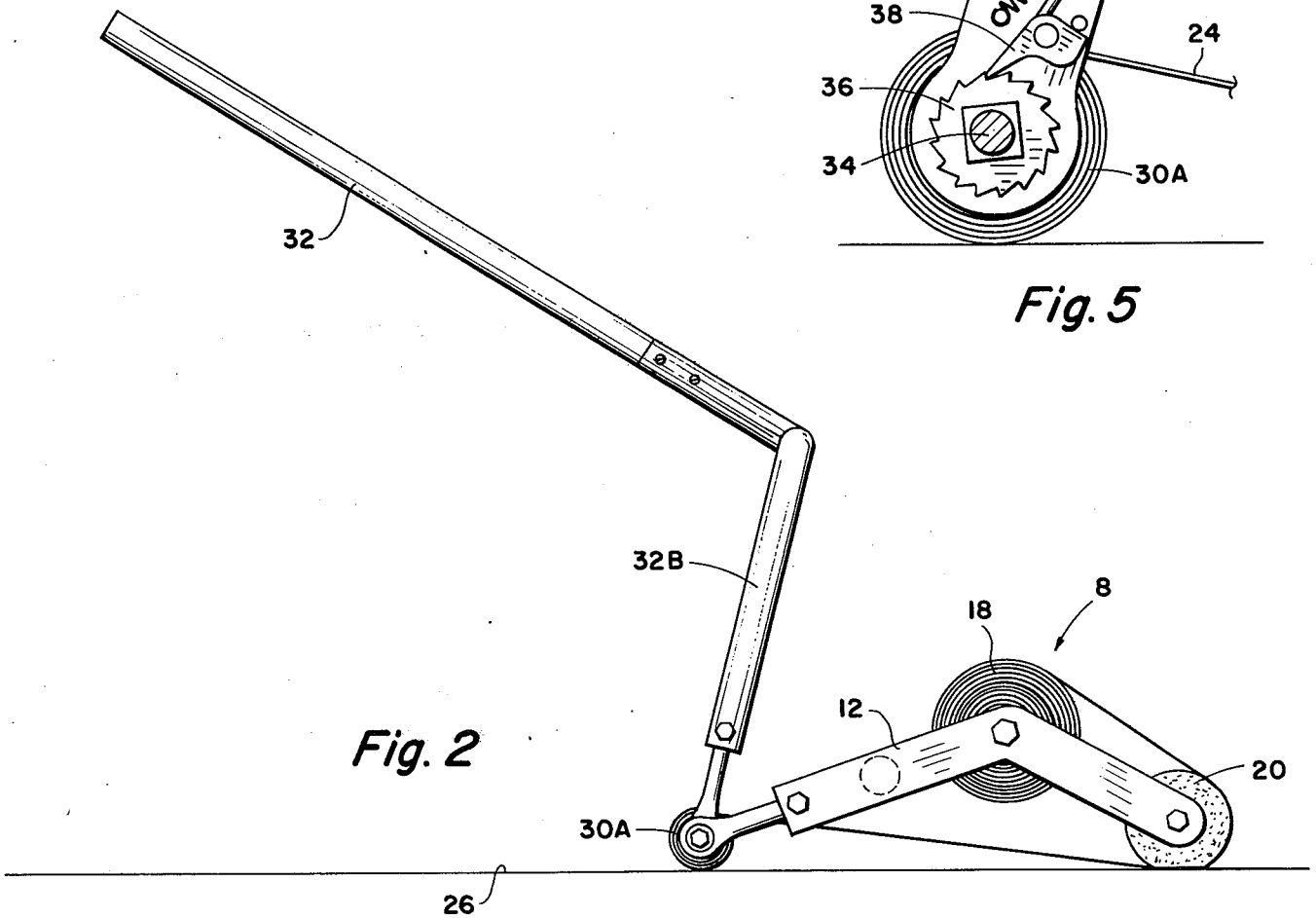
FIG. 2 is a side view of the device, with a portion of a handle shown as used in pulling the device over a bowling alley lane.
Figure 4:
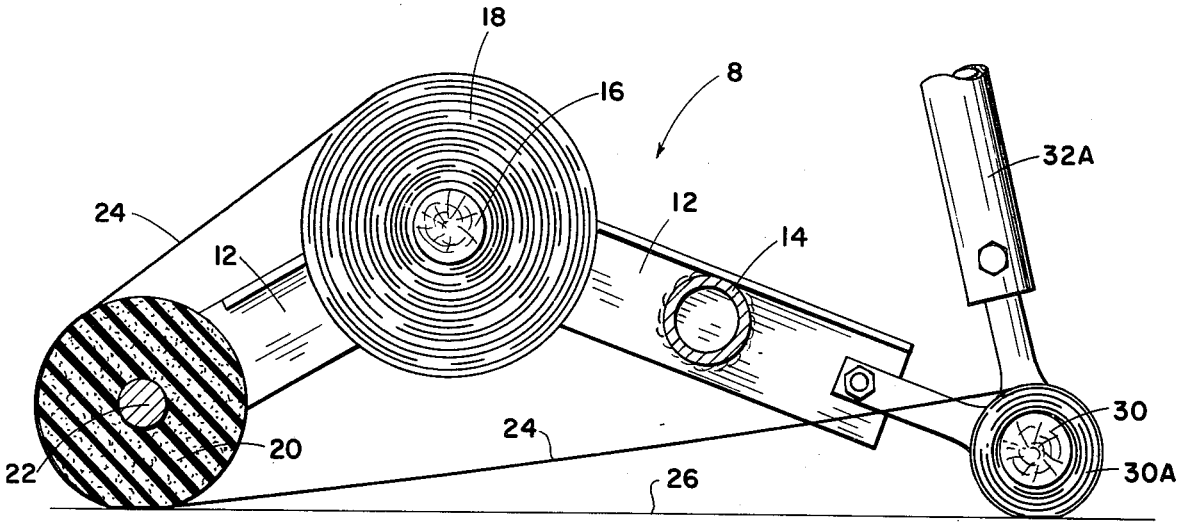
FIG. 4 is a cross-sectional view taken along line 4—4 of FIG. 1.

Also positioned between the end pieces 10 and 12 is an elongated resilient pad member 20. The pad member 20 may take a variety of forms. In the illustrated arrangement it is cylindrical and is, by example, a rubber or sponge cylinder 20 with a central metal rod 22 which supports the pad through the frame end pieces. The pad 20 is preferably positioned below the supply reel 16. Paper 24 from paper roll 18 passes around and under the pad 20 so as to engage a bowling alley lane surface 26 as shown in FIGS. 2, 3 and 4.

Also positioned between the end pieces 10 and 12 is a takeup reel 30 which receives paper 24. Pivotally secured to the frame is a handle 32 having U-shaped lower portion 32A and 32B. The upper end of handle 32 has means (not shown) whereby the operator may pull the lane cleaning device over a bowling alley lane surface.

Figure 5:
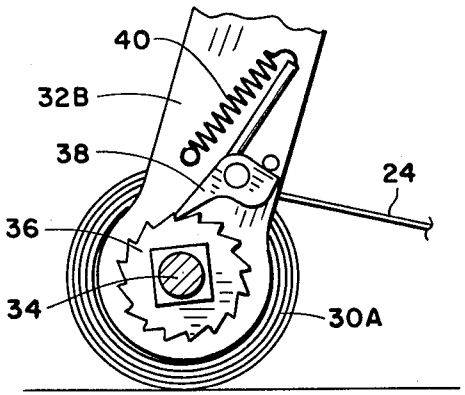
FIG. 5 is a detailed cross-sectional view taken along the line 5—5 of FIG. 1 showing one embodiment of a ratchet means which may be employed with the invention.

The bowling alley lane cleaner described to this point, including supply reel 16, paper roll 18, paper 24, pad 20 and takeup reel 30, is known in the art. As previously indicated most devices of this type require that the operator manually advance the takeup reel 30 to insure that clean paper 24 will be passed under the pad 20 to engage the lane surface 26. This invention is directed towards an improvement in this known arrangement and includes means of providing a ratcheting interrelationship between handle 32 and takeup reel 30. An axial member 34, as shown in FIG. 5, connects with the takeup reel 30. It has affixed axially thereto a ratchet gear 36. The axial member 34 is rotatably supported relative to the lower portion of handle portion 32B and also rotatably supported relative to frame end piece 12. Pivotally secured to the handle portion 32B is a ratchet 38 having a spring 40 which holds the ratchet in resilient engagement with the ratchet gear 36. Each time handle 32 is pivoted relative to frame 8, such as when the user picks up the device to carry it from one lane to another, the ratchet mechanism automatically advances takeup reel 30. Although not shown, a second ratchet arrangement may be used to insure that axial member 34 does not inadvertently rotate when the handle is pivoted in the direction opposite that which causes takeup reel 30 to rotate.

Figure 3:
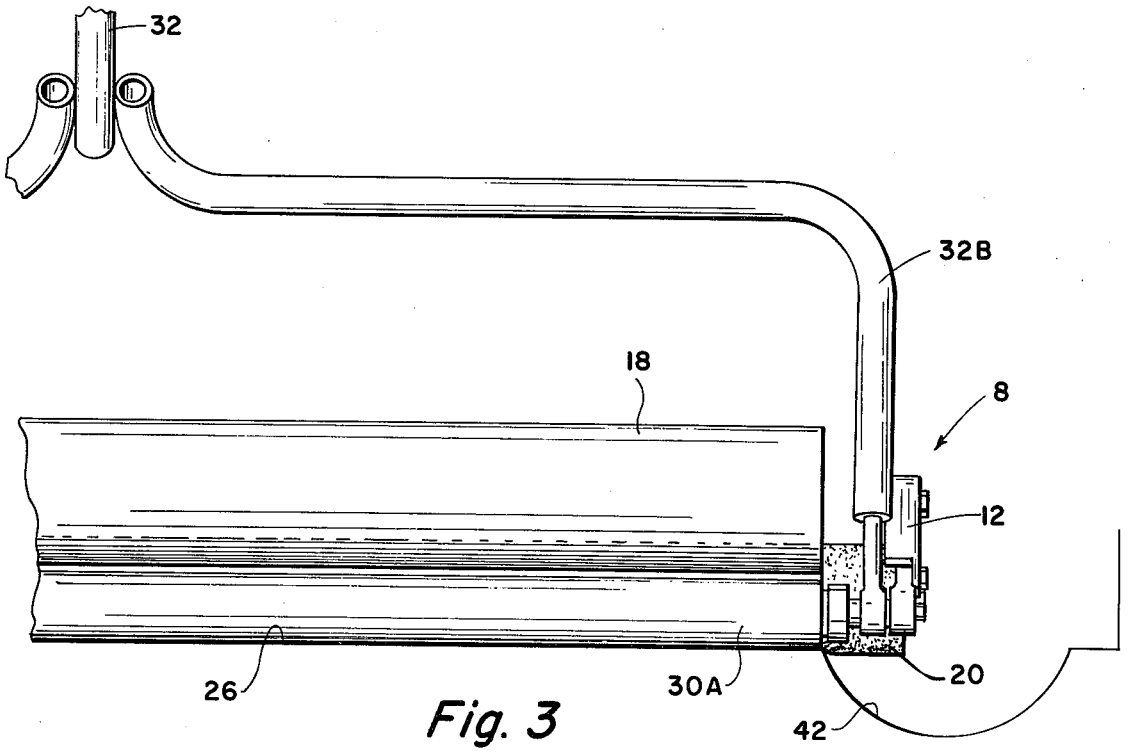
FIG. 3 is a broken away front view showing the device as utilized on a bowling alley lane.

The width of paper 24 is at least as wide as a bowling alley lane 26 and in like manner the length of reels 16 and 30 and the pad 20 are slightly wider than the width of the bowling alley lane and extend over the bowling lane gutter 42 as shown in FIG. 3. In the position shown in FIGS. 3 and 4 it can be seen that as the device is pulled along the lane paper 24 contacts the entire width of the lane 26 and cleans off any dust particles. In addition, with the takeup reel 30 mounted as illustrated with the paper 24 being wound around it in the direction opposite the paper on supply reel 18, if the device is pulled in the manner such that the takeup reel roll 30A is wound in a direction opposite paper 18 on the supply reel 16, then one side of paper 24 engages the lane 26 at pad 20 and the opposite side engages the lane under the takeup reel 30A thereby fully utilizing both sides of the cleaning paper. When the operator finishes with one lane and lifts the device by the handle to carry it to another lane it can be seen that frame 8 will swing downwardly since the whole device is pivoted to the handle 32. Then, when the device is placed on a different lane and pulled it will resume the position shown in FIG. 2. This pivotal movement of the frame relative to the handle causes the ratcheting of the takeup reel, such as by a mechanism as illustrated in FIG. 5, to automatically advance the paper each time the device is moved from one lane to another. In addition, if the lane is exceedingly dirty and the operator wishes to advance the paper when partway down the length of a lane, he can do so merely by raising and lowering the handle 32 without the necessity of stooping over or engaging any portion of the frame itself.

In order to facilitate the removal of takeup reel 30 when it has accumulated thereon all of the paper 18 from supply reel 16 and to position a new supply reel with a new roll paper 18, means is provided for expeditiously removing and replacing reels 16 and 30. This is best illustrated in FIG. 1. Left end piece 10 has tubular portions 44 and 46 secured thereto in axial alignment with the reels 16 and 30 respectively. A first pin 48 is slidably received in tubular element 44, the pin 48 having an enlarged outer end portion 50. A spring 52 positioned between the tubular element 44 and end portion 50 urges the pin 48 in the direction towards the end of reel 16. Reel 16 has a cavity means (not shown) in the end thereof which receives the end of end portion 50. Spring 52 normally retains the reel 16 in rotatable position between the frame end pieces 10 and 12. When it is desired to remove the reel 16, pin 48 is withdrawn, compressing spring 52, and permitting the reel 16 to be easily replaced.

Takeup reel 30 is similarly arranged with pin 54, end portion 56 and spring 58.

Normally, when all the paper has been moved from supply reel 16 to takeup reel 30 both reels are removed. The takeup reel has all dirty paper on it at this time and is therefore discarded. The supply reel 16 is then moved to the position of takeup reel 30 and a new roll of paper having with it a new supply reel 16 is inserted.

Figure 6:
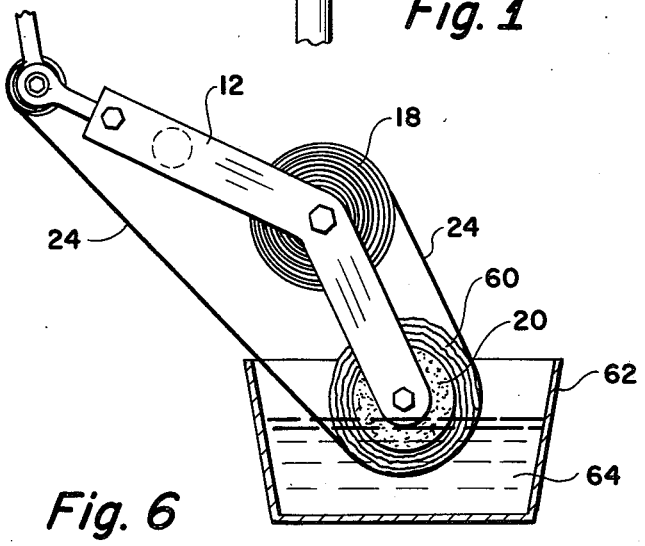
FIG. 6 is a side view showing the manner in which the device may be impregnated to apply cleaning fluid to a bowling alley lane.

FIG. 6 shows an alternate means of using the device for applying a cleaning fluid to a bowling alley lane surface 26. For this purpose a plurality of wraps of absorbent material 60, such as terry cloth or the like, is positioned around pad 20. Paper 24 is positioned on the outside of the layers of absorbent material 60. Prior to using the device to clean dust and oil from a bowling alley lane the device is lowered into an elongated pan 62 having a length greater than the pad 20. Pan 62 has a cleaning fluid 64 therein. The absorbent material 60 soaks up a quantity of cleaning fluid 64 and a small amount of the cleaning fluid soaks through paper 24. Subsequently, as the device is pulled over a bowling alley lane a small quantity of cleaning fluid is applied to the lane to enhance the cleaning operation.

As an alternate arrangement, the absorbent material 60 may be wrapped around takeup reel 30. In this arrangement the takeup reel with the absorbent material 30 thereon is soaked in the cleaning fluid 64 in pan 62 so that a small quantity of cleaning fluid is applied to the paper as the device is pulled over a bowling alley lane. Of course, absorbent material may be used on both the pad 20 and the takeup reel 30; however, this is seldom necessary.

The ratchet mechanism previously described advances new paper around the wraps of absorbent material 60 each time the device is picked up and carried to a new lane and repositioned in cleaning attitude on the new lane. The newly advanced paper receives cleaning fluid from the absorbing material 60 so that by dipping the device into the pan of cleaning fluid 62 one time several bowling alley lanes may be cleaned before it is necessary to again saturate the absorbent material 60.

The invention described fulfills the objectives initially set forth and provides a highly improved device for cleaning bowling alley lanes. It includes means whereby cleaning paper can easily and expeditiously be supplied to the machine and the takeup reel easily removed when all of the paper on the roll is then consumed. Most particularly it provides an arrangement wherein the cleaning paper is automatically advanced each time the device is picked up and moved to a new bowling alley lane so that without the necessity of the operator remembering to advance the paper and without requiring the operator to make any special effort to advance the paper, clean paper is always presented each time a bowling alley lane is to be cleaned.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed:

1. A device for cleaning bowling alley lanes comprising:

a frame having parallel end pieces spaced apart wider than the width of a bowling alley lane;

a supply reel having a roll of cleaning paper thereon, the reel being rotatably mounted between said frame end pieces;

an elongated cylindrical pad of resilient material extending between and mounted on said frame end pieces, said pad spaced from and parallel to and below said supply reel;

a takeup reel rotatably mounted between said frame end pieces, parallel to and below said supply reel and parallel to said pad but on the far side of said supply reel, paper from said supply reel being looped over said pad and around the takeup reel whereby said pad holds the paper in contact with the bowling alley lane as the device is pulled over a lane;

a handle for pulling the device over a bowling alley lane, the handle being pivotally secured to said frame and pivotal about the axis of said takeup reel;

a ratchet gear axially affixed to said takeup reel at one end thereof;

a ratchet tooth pivoted to said handle at one end, the other end slidably engaging said ratchet gear;

whereby each time the device is lifted from a lane and said handle is pivoted relative to said frame, said takeup reel is rotated to advance paper from the supply reel to expose clean paper between said pad and the bowling alley lane being cleaned.

2. A device for cleaning a bowling alley according to claim 1 wherein said handle includes a U-shaped portion providing a first and second terminal, one terminal being rotatably connected to one of said frame end pieces in axial alignment with said takeup reel and the second terminal being connected adjacent said ratchet gear.

3. A device for cleaning a bowling alley according to claim 1 including:

a layer of absorptive material wrapped around said cylindrical pad whereby said absorptive material may be soaked in a liquid to be applied to a bowling alley lane.

4. A device for cleaning a bowling alley lane according to claim 1 wherein said pad includes a rigid cylindrical core member secured at each end to a said frame end piece and a tubular layer of resilient material encompassing the cylindrical surface of the core member.

5. An apparatus for cleaning a bowling alley lane according to claim 1 including:

a first bolt member slidably supported by a said frame end piece in axial alignment with said supply reel;

a spring compressibly received between said frame end piece and a portion of said first bolt member resiliently urging the bolt member towards said supply reel, the inner end of the first bolt member engaging one end of said supply reel in a manner permitting the rotation of the supply reel when the bolt member is inwardly displaced by spring pressure towards the supply reel and permitting the supply reel to be removed from the frame when the bolt member is manually displaced against spring pressure;

a second bolt member slidably supported by a said frame end piece in axial alignment with said takeup reel; and a spring compressibly received between said latter frame end piece and a portion of said second bolt member resiliently urging the bolt member towards said takeup reel, the inner end of the second bolt member engaging one end of said takeup reel in a manner permitting the rotation of said takeup reel when the bolt member is inwardly displaced by spring pressure towards the takeup reel and permitting the takeup reel to be removed from the frame when the bolt member is manually displaced against spring pressure.

* * * * *